United States Patent [19]

Reimer et al.

[11] 4,412,712

[45] Nov. 1, 1983

[54] CIRCUIT BOARD POSITIONING ARRANGEMENT

[75] Inventors: William A. Reimer, Wheaton; Ansano Bertellotti, Addison, both of Ill.

[73] Assignee: GTE Automatic Electric Labs Inc., Northlake, Ill.

[21] Appl. No.: 314,169

[22] Filed: Oct. 23, 1981

[51] Int. Cl.[3] ..... H01R 23/72

[52] U.S. Cl. ..... 339/17 M; 339/176 MP

[58] Field of Search ..... 339/172 M, 17 M, 176 MP; 361/412, 413

[56] References Cited

U.S. PATENT DOCUMENTS

| | | | |
|---|---|---|---|
| 3,478,251 | 11/1969 | Perotto et al. | 339/17 LM |
| 3,644,868 | 2/1972 | Nevala | 339/17 LM |
| 3,736,471 | 5/1973 | Donze et al. | 339/17 LM |
| 3,924,918 | 12/1975 | Friend | 339/17 M |
| 4,107,760 | 8/1978 | Zimmer | 361/412 |

FOREIGN PATENT DOCUMENTS

| | | | |
|---|---|---|---|
| 2431788 | 1/1976 | Fed. Rep. of Germany | 339/17 LM |

*Primary Examiner*—John McQuade

*Attorney, Agent, or Firm*—Robert J. Black; Charles A. Doktycz

[57] ABSTRACT

A circuit board positioning arrangement for multiple of circuit boards. Support apparatus maintains the circuit boards in a spaced parallel relationship while permitting movement of one board relative to another. Sequencing apparatus fixed to one of the boards engages receiving apparatus on another, positioning one of the boards forward of another. When force is applied to the least advanced board, the most advanced board engages an associated connector. Continued application of force then causes the sequencing apparatus to release allowing the next most advanced board to engage its connector.

10 Claims, 6 Drawing Figures

CIRCUIT BOARD POSITIONING ARRANGEMENT

BACKGROUND OF THE INVENTION (1) Field of the Invention

The present invention relates in general to circuit boards and connectors, and more particularly to the sequential mating of circuit boards with their respective connectors.

(2) Description of the Prior Art

In designing electrical systems, a major consideration is the packaging of circuitry on printed circuit boards. Of the many factors to be considered, one is the quantity of connectors available for forming electrical connection between circuit boards. With conventional connectors and printed circuit boards there exists a proportional relationship between the quantity of electrical connections to a circuit board and the insertion force required to mate the printed circuit board with its connector. That is, the quantity of electrical connections to a printed circuit board increases so too does the insertion force required to mate that board with its connector. Further, insertion force varies, being high initially as a circuit board engages and spreads apart its connector's spring contacts and thereafter, is subsequently greatly reduced as the connector's spring contacts slide along the circuit board's terminals while the circuit board is being fully seated within its associated connector.

Printed circuit boards requiring high insertion force are undesirable in that they require strengthened connectors and connector mounting hardware. They also require strengthening of the printed circuit board, and in many cases require the development of special card insertion and extraction hardware.

Several methods are known to combat the high insertion force problem. Of these, one is to interconnect the circuit boards not through a connector but rather through direct contact between the two circuit boards involved. Such a technique is described in U.S. Pat. No. 3,924,918, entitled "Daughter Board Contact" to Lindsay Carlton Friend, issued Dec. 9, 1975. This patent teaches electrical connection between spaced and parallel mother and daughter boards by means of terminals secured to the mother board projecting toward the daughter board. The terminals include a pivot link arm, daughter board spring contacts, and a daughter board engaging member at the free end of the link. Such an arrangement is undesirable in that it does not allow the daughter board to be mounted in a conventional card file with the usual card guides, thus obtaining the support provided therefrom.

Another technique is described in U.S. Pat. No. 3,953,096, entitled "Free Standing Mother Daughter Printed Circuit Board Contact Arrangement" to Benjamin Charles Williams, issued Apr. 27, 1976. This patent teaches free standing metal contacts mounted, in a straight line, on a first board and adapted to receive, hold, and make electrical connection with a second circuit board. This technique as well as that described above, requires the fabrication, on the mother or first board, of connector contacts to be engaged by the second or daughter board. The inclusion of contacts on boards is costly and generally undesirable.

Yet another method to combat the high insertion force problem is taught in U.S. Pat. No. 4,008,939 issued Feb. 22, 1977 to Robert John Kinkaid titled "Axially Cammed Housing for Low Insertion Force Connector," which teaches a two piece dielectric connector housing including a rotatable shaft and electrical contacts. The connector housing is provided with receptacle passage ways adapted to receive electrical terminals. Electrical contacts mounted within the connector housing are positioned so as to not contact the electrical terminals when they are inserted into the housing thereby avoiding the high insertion force problem. Once the electrical terminals are inserted within the connector housing, the shaft is rotated to bias the electrical contacts into engagement with the terminals providing electrical contact therebetween. This technique requires manufacture of mechnically complicated and expensive connectors.

A method to combat the high insertion force problem, and overcome those objections raised above is the subject of the present invention, as hereinafter described.

SUMMARY OF THE INVENTION

The primary purpose of this invention is to reduce initial and subsequent the insertion forces of a conventional circuit board with a given quantity of electrical contacts engaging a conventional connector. Alternatively, this invention is useful in increasing the quantity of electrical contacts available on a circuit board without increasing the insertion forces required to mate that circuit board with its connector.

The above two purposes are accomplished in one embodiment by adding to the circuit board a secondary small printed circuit board mechanically spaced away by a support body and electrically connected by conventional means such as flexible wiring. Connectors are provided to mate with the printed circuit boards along an edge of each board provided for that purpose. Electrical contacts are distributed along each board's connector engaging portion and, in conjunction with terminals provided within the connector bodies, provide external access to printed circuit board mounted circuitry. The support body is fixed to the primary circuit board and slidably engages the secondary circuit board thereby allowing the secondary circuit board to be advanced relative to the primary circuit board in one position and, in the retracted position, to be positioned even with the primary circuit board.

A mechanism is included to maintain the secondary circuit board in an advanced position and at the appropriate time release, thereby allowing the secondary circuit board to slide and assume a non-advanced position relative to the primary circuit board. A receiving slot with a leading edge is provided in the secondary circuit board for use by the above mechanism in controlling the advanced position of the secondary circuit board. The sequencing mechanism consists of a resilient arm having its first end mounted to the support body at the primary circuit board and a second end fabricated to include a ramp which engages the leading edge of the receiving slot when the secondary board is in its advanced position. The resilient arm's ramp is constructed so as to permit forceable ejection of the resilient arm from the sequencing slot when sufficient force is applied to the secondary circuit board by its respective connector.

This embodiment is operated by applying force to the primary circuit board in a direction to mate it with its connector. Because of its advanced position relative to the primary circuit board, the secondary circuit board will engage and mate with its connector first. Continued application of force resisted by the secondary connector, when the secondary circuit board is fully seated, will reposition the resilient arm relative to the receiving aperture removing it from contact with the receiving aperture thereby allowing the secondary board to cease movement and allowing the primary board to mate and seat with its connector.

To remove the two circuit boards from their respective connectors and reset the mechanism of the above embodiment, force is exerted in a direction opposite that used to engage the circuit boards in their connectors. With the application of this force the primary circuit board will move out of engagement with its connector and, once free, be in a position relative to the second circuit board such that the resilient arm may reposition itself relative to the receiving slot and thereby engage it. The further application of force will remove the secondary circuit board from its connector thereby completing the removal and resetting process.

Another embodiment is disclosed herein utilizing similar primary and secondary circuit boards and their respective connectors together with a similarly positioned and functioning support body and receiving aperture with leading edge. The sequencing mechanism of this embodiment however, is a cam of rigid construction having a first end pivotally mounted about a point within the support body. The cam's second end includes an actuating edge which engages the leading edge of the receiving aperture to control the position of the second printed circuit board. The cam in a first position maintains the secondary circuit board in an advanced position relative to the primary circuit board, and in the second position allows the secondary circuit board to assume a nonadvanced position. A slide is included to lock the cam in its first position and to sense the position of the second circuit board relative to its connector. A lip is provided in the slide construction which engages a finger mounted to the cam's second end when the slide is in an advanced position relative to the secondary circuit board. A frontal edge is provided on the slide to contact the secondary printed circuit board connector. When the secondary printed circuit board has mated with its connector and spread the connector's spring contacts sufficiently to allow passage of the circuit board, the frontal edge will move the slide and thus release the lip from engagement with the cam finger thereby freeing the cam to rotate.

This second embodiment may be operated by applying force to the primary circuit board in a direction to cause engagement of both circuit boards with their respective connectors. Because of its initially advanced position, the secondary circuit board will mate with its connector first. Upon mating, the slide frontal edge will engage the secondary printed circuit board connector and release the cam. Continued application of force to the primary circuit board will then move it into engagement with its connector, spreading the connector's contacts as described above for the secondary circuit board, pivoting the cam to its second position, and moving the secondary circuit board to a non-advanced position relative to the primary circuit board. Further application of force to the primary circuit board will then advance both circuit boards to a fully seated position within their respective connectors.

The circuit boards are removed from engagement with their connectors and the mechanism reset by applying force to the primary circuit board in a direction opposite that used to engage the circuit boards. Application of this force will cause the primary circuit board to disengage its connector and cause the secondary circuit board to assume an advanced position relative to the primary circuit board. The continued application of force will disengage the secondary circuit board from its connector. Following disengagement of the circuit boards from their respective connectors the sequencing mechanism of the second embodiment is reset by pivoting the cam back to its first position using a reloading lever provided for that purpose. The slide is then advanced causing its lip to engage the cam detention finger thus locking the cam in its first position and completing the reset procedure.

BRIEF DESCRIPTION OF THE DRAWINGS

A better understanding of the subject invention may be had by consideration of the following detailed description taken together with FIGS. 1-6.

A first embodiment is shown in FIGS. 1-3 in which.

Figure 4:
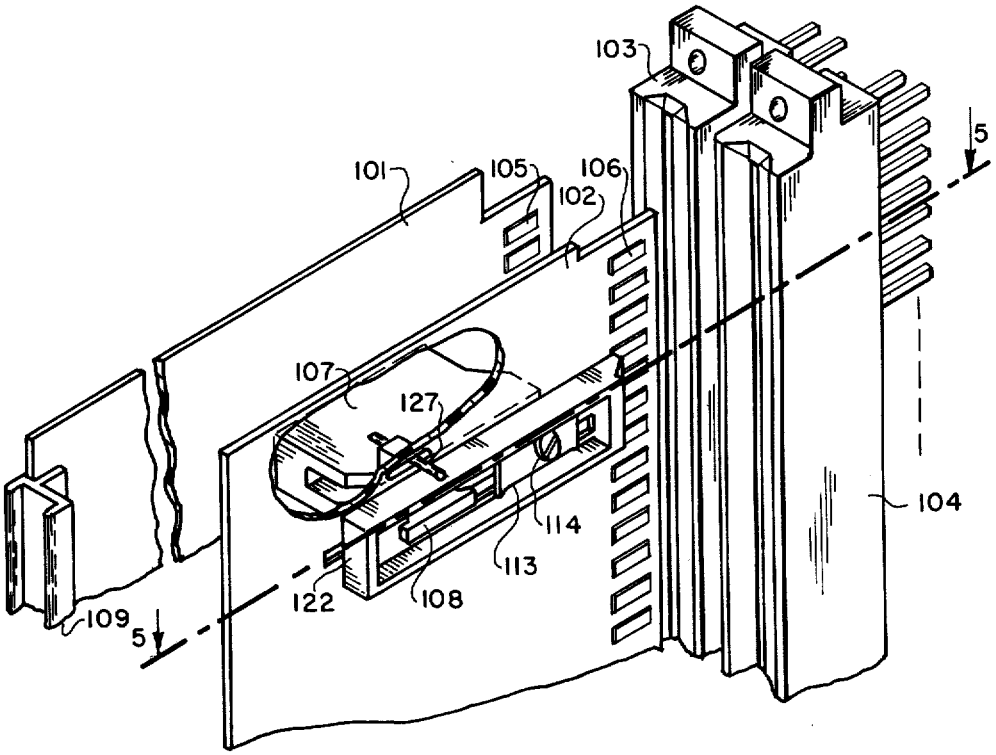
Figure 5:
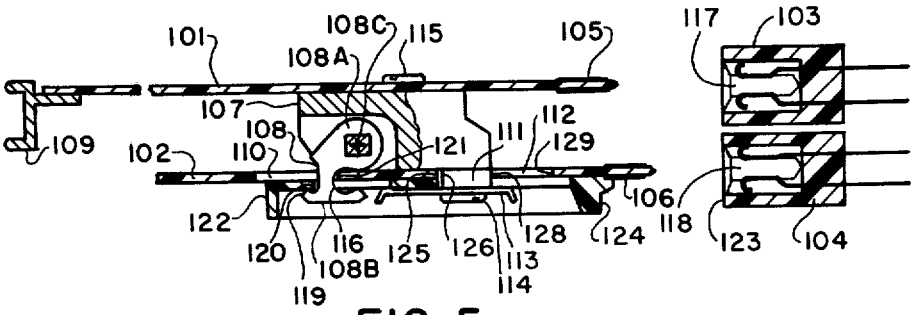
Figure 6:
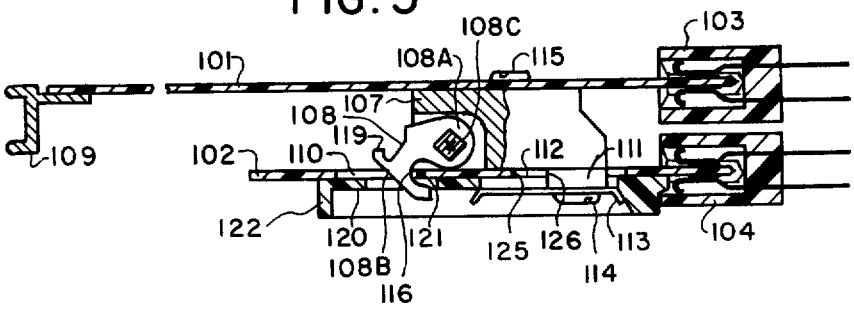

A second embodiment is depicted in FIGS. 4-6 in which:

FIG. 4 is a perspective view of the two printed circuit boards adapted to be sequentially mated with their respective connectors using reduced insertion force.

FIG. 5 is a sectional view, taken substantially along line 5—5 shown in FIG. 4, showing the adapted circuit boards and the sequencing mechanism of the second embodiment in position to be sequentially mated with their respective connectors.

FIG. 6 is a sectional view similar to that of FIG. 5 showing the released sequencing mechanism of the second embodiment and the adapted circuit boards in mated position with their respective connectors.

DESCRIPTION OF THE PREFERRED EMBODIMENTS

Figure 1:
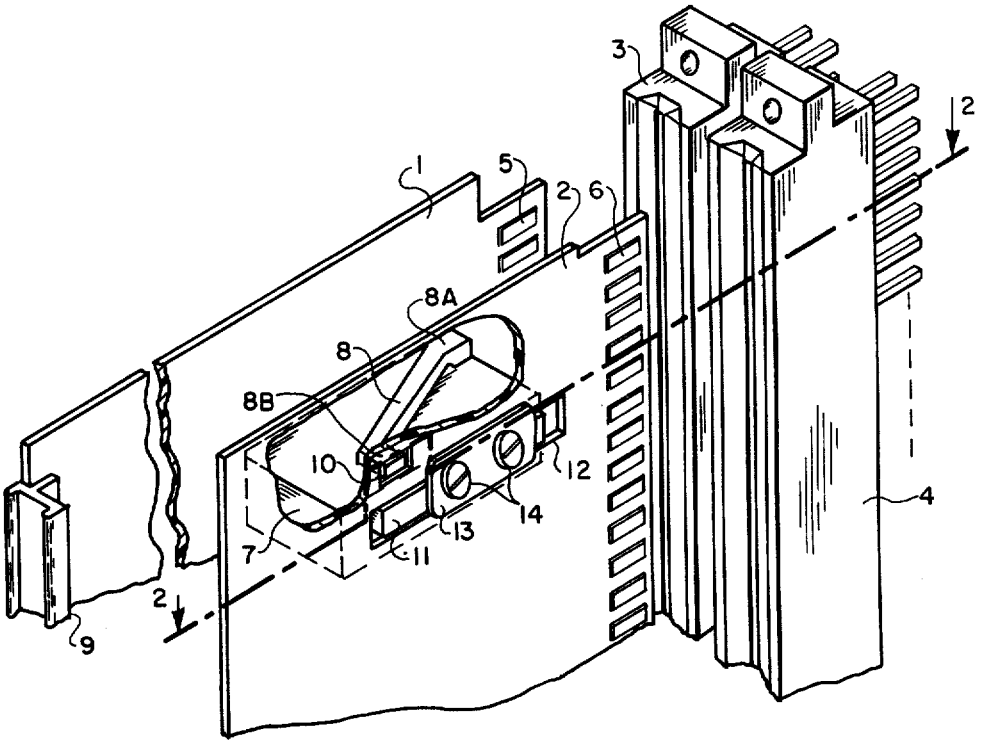
FIG. 1 is a perspective view of two printed circuit boards adapted to be sequentially mated with their respective connectors using reduced insertion force.
Figure 2:
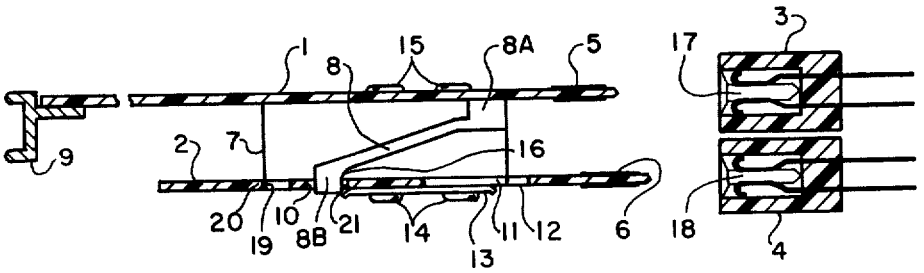
FIG. 2 is a sectional view, taken substantially along line 2—2 shown in FIG. 1, showing the adapted circuit boards and the sequencing mechanism in position to be mated with their respective connectors.

Referring now to FIGS. 1 and 2 in which are shown the first embodiment including primary circuit board 1 and secondary circuit board 2 each arranged with connector engaging portions 5 and 6 respectively. Circuit board connectors 3 and 4 are of standard design and are provided and positioned to be engaged by primary circuit board 1 and secondary circuit board 2 within board receiving cavities 17 and 18 respectively. Handle 9 is provided and fixed to primary circuit board 1 for the purpose of inserting, extracting, and handling the printed circuit board assembly.

Primary circuit board 1 and secondary circuit board 2 are maintained in spaced parallel relationship by means of support body 7 which is affixed to primary circuit board 1 by means of fasteners 15. Support body 7 includes board guide 11 adapted to engage channel 12 of secondary circuit board 2 and to allow reciprocal movement of secondary circuit board 2 in the direction of its connector engaging portion 6. Guide 11 is held in engagement with channel 12 by means of retaining tension spring 13 and fasteners 14. Secondary circuit board 2 contains sequencing aperture 10 which is useful in controlling the position of secondary circuit board 2 relative to primary circuit board 1 as is described below.

Resilient arm 8 is provided with a first end 8A fixed to support body 7 adjacent to primary circuit board 1. Resilient arm second end 8B is fabricated with a ramp 16 positioned to engage sequencing aperture 10 when secondary circuit board 2 is in an initial or advanced position relative to primary circuit board 1. Secondary circuit board 2 is maintained in its advanced position by action of ramp 16 against edge 21 of sequencing aperture 10. Edge 20 of channel 12 abuts edge 19 of guide 11 when secondary circuit board 2 is moved to its advanced position limiting movement thereat.

Figure 3:
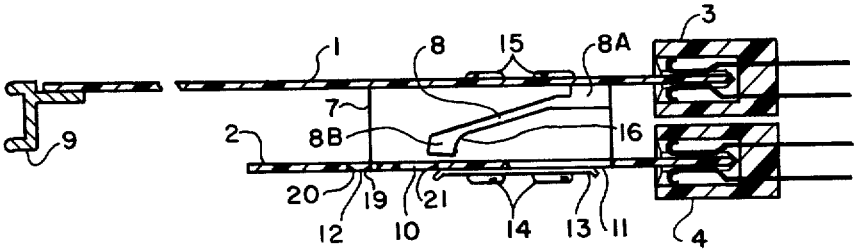
FIG. 3 is a sectional view similar to FIG. 2 showing the released sequencing mechanism of the first embodiment and the adapted circuit boards in mated position with their respective connectors.

Referring now to FIGS. 2 and 3 the operation of the first embodiment will be described. Force applied to handle 9 in the direction of primary circuit board connector engaging portion 5 will, because of its advanced position, cause secondary circuit board 2 to engage connector 4, spread the connector's contacts sufficiently to allow board passage, and seat connector engaging portion 6 fully in the connector's board receiving cavity 18. The continued application of force to handle 9 resisted by secondary circuit board connector 4 will then cause edge 21 of sequencing aperture 10 acting against ramp 16 to reposition resilient sequencing arm second end 8B relative to and out of engagement with itself thereby allowing secondary circuit board 2 to move relative to primary circuit board 1. The further application of force to primary circuit board 1 will then cause it to move relative to secondary circuit board 2, engage connector 3, spread the connector's contacts sufficiently to allow board passage, and fully seat its connector engaging portion 5 within circuit board receiving cavity 17.

Disengagement of circuit boards 1 and 2 from connectors 3 and 4 respectively, and resetting of the sequencing mechanism of the first embodiment is accomplished by applying force to handle 9 in a direction away from its connector engaging portion 5. Application of this force will first cause primary circuit board 1 to move relative to secondary circuit board 2 and disengage connector 3. The continued application of force will then allow resilient sequencing arm second end 8B to reposition itself relative to sequencing aperture 10 thereby engaging it. Additionally, edge 19 of guide 11 will contact edge 20 of channel 12. The further application of force will then move secondary circuit board 2 out of engagement with connector 4 thereby completing the disengagement of circuit boards 1 and 2 from connectors 3 and 4 and the resetting of the sequencing mechanism of the first embodiment.

The second embodiment may be more fully understood by referring to FIGS. 4 and 5 in which are shown primary circuit board 101 and secondary circuit board 102 each arranged with connector engaging portions 105 and 106 respectively. Primary and secondary printed circuit board connectors 103 and 104 are provided and positioned to be engaged by primary circuit board 101 and secondary printed circuit board 102 within board receiving cavities 117 and 118 respectively. Handle 109 is provided and fixed to primary circuit board 101 for the purpose of inserting, extracting, and handling the printed circuit board assembly.

Primary circuit board 101 and secondary circuit board 102 are maintained in spaced parallel relationship by support body 107 which is affixed to primary circuit board 101 by means of fastener 115. Support body 107 includes board guide 111 adapted to engage channel 112 of secondary circuit board 102 and allow reciprocal movement of said circuit board in the direction of its connector engaging portion 106. Guide 111 is held in engagement with channel 112 by means of retaining tension spring 113 and fastener 114. Secondary printed circuit board 102 contains sequencing aperture 110 in which is positioned second end 108B of cam 108. First end 108A of cam 108 is pivotally mounted about pivot point 108° C.

Cam 108 in its initial position locates secondary circuit board 102 in an advanced position relative to primary circuit board 101, by means of interaction between cam actuating edge 116 and sequencing aperture leading edge 121. Cam 108 is held in its initial position by lip 120 of slide 122 (in its advanced position) and interaction with cam finger 119. Edge 125 of channel 112 is provided to engage trailing edge 126 of board guide 111 to limit advancement of circuit board 102 relative to circuit board 101 while edge 128 of board guide 111 cooperates with edge 129 of channel 112 to limit movement in the opposite direction. Slide 122 contains frontal edge 124 positioned to contact face 123 of secondary printed circuit board connector 104. A reloading lever 127 is provided and attached at cam first end 108A to return cam 108 to its initial position.

Referring now to FIGS. 5 and 6 the operation of the second embodiment will be described. Force is applied to handle 109 in the direction of its connector engaging portion 105. This will, because of its advanced position, cause secondary circuit board 102 to engage connector 104, spread the connector's contacts sufficiently to allow board passage, and partially seat connector engaging portion 106 in the connector's board receiving cavity 118. Simultaneously, slide frontal edge 124 contacts face 123 of connector 104 preventing further advancement of slide 122. Slide 122 will then retract relative to secondary circuit board 102 releasing cam finger 119 from engagement with lip 120 of slide 122 when secondary circuit board 102 is in its partially seated position allowing cam 108 to rotate.

The continued application of force to handle 109 following the release of cam 108 will cause leading edge 121 of sequencing aperture 110 to contact cam actuating edge 116, and through action thereat, rotate cam 108 to its second position. Simultaneously, support body 107 and with it primary circuit 101 will advance relative to secondary circuit board 102 thereby allowing primary circuit board 101 to engage connector 103, spread the connector's contacts sufficiently to allow board passage, partially seat its connector receiving portion 105 within printed circuit board receiving cavity 117, and assume a nonretracted position relative to the secondary circuit board. Further application of force to handle 109 will then, by action directly via circuit board 101 and through edge 128 of board guide 111 acting against edge 129 of channel 112, advance both circuit boards to their fully seated positions within their respective connectors.

Disengagement of circuit boards 101 and 102 from connectors 103 and 104 respectively and resetting of the sequencing mechanism of the second embodiment is accomplished by applying force to handle 109 in a direction away from its connector engaging portion 105. Application of this force will first cause primary circuit board 101 to move relative to circuit board 102 and disengage connector 103. The continued application of force will then cause edge 125 of channel 112 to contact edge 126 of guide 111 and through action thereat disengage secondary circuit board 102 from connector 104.

Following the removal of circuit boards 101 and 102 from their respective connectors the sequencing mechanism of the second embodiment is reset by rotating cam 108 back to its initial position using lever 127 shown in FIG. 4. Cam 108 is locked in its initial position by moving slide 122 forward engaging lip 120 under cam finger 119.

The present invention has been described with reference to the preferred embodiments thereof for the purpose of illustrating the manners in which the invention may be used to advantage. It is recognized various other equivalent and equally useful configurations could no doubt be substituted by the skilled practitioner after becoming knowledgeable of the principles and rudiments of the present invention. It is therefore believed, all matter contained in the above description or shown in the accompanying drawings should be interpreted as illustrative and not in the limiting sense, the subject invention being limited only as set forth in the claims, to wit:

What is claimed is:

1. A circuit board positioning arrangement for use with at least two circuit boards, each board including a connector engaging edge portion, each of said edge portions sequentially positionable in contact with an associated connector, a first one of said boards initially located farther from its associated connector than a second one of said boards is from its associated connector, said positioning arrangement comprising:

receiving means included in at least one of said boards;

support means adapted to position and maintain said boards in parallel and spaced relationship while permitting lateral movement of at least one of said boards relative to another; and sequencing means included in at least another one of said boards and initially positioned in contact with said receiving means;

whereby, said second board initially located closer to its associated connector is placed in contact with its associated connector in response to the initial application of force to said first board, and in response to the continued application of said force to said first board, said sequencing means is repositioned relative to said receiving means and said first board is positioned in contact with its associated connector.

2. A circuit board positioning arrangement as claimed in claim 1 wherein: said receiving means is an aperture with a leading edge.

3. A circuit board positioning arrangement as claimed in claim 2 wherein: said aperture is a slot.

4. A circuit board positioning arrangement as claimed in claim 1 wherein: said support means is fixed to one of said boards in a manner to allow movement therebetween.

5. A circuit board positioning arrangement as claimed in claim 1 wherein: said support means is rigidly fixed to one of said boards.

6. A circuit board positioning arrangement as claimed in claim 1 wherein: said sequencing means is of resilient construction to facilitate said repositioning relative to said receiving means.

7. A circuit board positioning arrangement as claimed in claim 6 wherein: said sequencing means further includes first and second ends; said first end rigidly associated with one of said boards and said second end arranged to engage said receiving means.

8. A circuit board positioning arrangement as claimed in claim 7 wherein: said receiving means comprises an aperture with a leading edge and said second end includes a ramp adapted to contact said aperture leading edge to retain said board initially located closer to its associated connector in a position advanced relative to said other board.

9. A circuit board positioning arrangement as claimed in claim 1 wherein: said sequencing means comprises a cam of rigid construction with first and second ends; said first end rotatable about a pivot point and said second end comprising an actuating edge, and in response to said continued application of force to said first board, said second board contacting said cam actuating edge causing said cam to rotate about said pivot point facilitating the repositioning of said sequencing means relative to said receiving means thereby allowing said second board to be repositioned relative to said first board.

10. A circuit board positioning arrangement as claimed in claim 9 wherein: said cam includes a finger and said sequencing means includes a slide which includes a lip initially engaging and cooperating with said finger to prevent rotation of said cam; said slide further including a frontal edge, engaging said associated connector of said second board to remove said lip from engagement with said finger, permitting rotation of said cam.

* * * * *